US005890374A

United States Patent [19]

Lee

[11] Patent Number: 5,890,374

[45] Date of Patent: Apr. 6, 1999

[54] OIL SEPARATOR FOR EVAPORATOR

[75] Inventor: Sung Tae Lee, Suwon, Rep. of Korea

[73] Assignee: Samsung Electronics Co., Ltd., Suwon, Rep. of Korea

[21] Appl. No.: 869,987

[22] Filed: Jun. 5, 1997

[30] Foreign Application Priority Data

Jun. 10, 1996 [KR] Rep. of Korea ..... 1996 20627

[51] Int. Cl.[6] ..... F25B 43/02

[52] U.S. Cl. ..... 62/471; 62/192

[58] Field of Search ..... 62/192, 468, 470, 62/471

[56] References Cited

U.S. PATENT DOCUMENTS

| | | | |
|---|---|---|---|
| 1,951,915 | 3/1934 | Kagi | 62/471 |
| 4,472,949 | 9/1984 | Fujisawa et al. | 62/468 X |
| 4,551,990 | 11/1985 | Honoshowsky | 62/468 |
| 5,036,679 | 8/1991 | Zlobinsky et al. | 62/470 |
| 5,347,817 | 9/1994 | Kim | 62/471 |
| 5,551,253 | 9/1996 | Kim | 62/470 |

*Primary Examiner*—Henry Bennett
*Assistant Examiner*—Susanne C. Tinker
*Attorney, Agent, or Firm*—Burns, Doane, Swecker & Mathis, L.L.P.

[57] ABSTRACT

An oil separator for an evaporator in a cooling system is installed between a capillary tube and the evaporator for separating oil from the refrigerant flowing into the evaporator. The oil separator comprises an inflow member connected to the capillary tube, for receiving the oil-containing refrigerant therefrom. A refrigerant outflow member is connected between the inflow member and an inlet of the evaporator, for conducting the refrigerant upward to the inlet of the evaporator. An oil outflow member is disposed between the inflow member and an outlet of the evaporator, for conducting the oil downward to an outlet of the evaporator. The oil separator prevents oil from flowing into the evaporator, thereby preventing accumulation of the oil inside the evaporator which could reduce the amount of oil disposed inside a compressor of the cooling system.

2 Claims, 5 Drawing Sheets

OIL SEPARATOR FOR EVAPORATOR

BACKGROUND OF THE INVENTION

The present invention relates to an oil separator for an evaporator, and more particularly, to an oil separator for separating oil from refrigerant.

In such a product as a refrigerator or an air conditioner employing cool air, a cooling cycle including the processes of compressing, condensing and evaporating refrigerant is performed to generate the cool air.

Referring to FIGS. 4 and 5, a cool air generating system typically includes a compressor 51, a condenser 53, a capillary tube 55 and an evaporator 57. The compressor 51 compresses a gaseous refrigerant to a high-temperature and high-pressure gas and the condenser 53 condenses the high-temperature and high-pressure gaseous refrigerant to a high-pressure liquid. The liquefied high-pressure refrigerant is depressurized while passing through the capillary tube 55 and the depressurized refrigerant flows into the evaporator 57 and is then vaporized. While being vaporized, the refrigerant absorbs heat from air around the evaporator 57 to generate cool air. The thus-generated cool air is supplied to a cold storage and a freezing compartment of a refrigerator or inside a room. The vaporized refrigerant returns to the compressor 51 from the evaporator 57 to be compressed into the high-temperature and high-pressure gas.

In such a cooling system, since the compressor 51 compresses the refrigerant by a mechanical operation thereof, lubricating oil for mechanical parts of the compressor is needed. The lubricating oil is inevitably mixed into the refrigerant during the cooling cycle, and the refrigerant containing the oil circulates through the cooling system. When the liquid refrigerant containing the lubricating oil flows into the evaporator 57 to be vaporized, the lubricating oil maintains the liquid state and is separated from the vaporized refrigerant in a separator 58. Thus, the lubricating oil remains and accumulates inside the evaporator 57. This phenomenon is severe in the case that an ester oil is mixed into an HFC-134a refrigerant. Especially, when a mineral oil which is mainly used at the time of assembling the compressor 51 is mixed with the ester oil in the evaporator, separation of the mixed oil from the refrigerant during the vaporization in the evaporator 7 is significantly remarkable, to thereby increase the accumulation of the oil inside the evaporator 57.

The accumulation of the oil inside the evaporator obstructs a sufficient heat absorption from air around the evaporator, thereby decreasing a cooling efficiency. Accordingly, the amount of the lubricating oil inside the compressor becomes decreased resulting in abrasion of internal parts of the compressor, thereby decreasing a compressing efficiency and affecting the entire operation of the cooling system.

SUMMARY OF THE INVENTION

It is an object of the present invention to provide an oil separator for an evaporator which is capable of separating oil from refrigerant flowing into the evaporator to prevent accumulation of the oil inside the evaporator and reduction of the oil inside a compressor, thereby maintaining the functions of the compressor and the evaporator and improving a cooling effect.

To accomplish the above object, there is provided an oil separator for an evaporator installed between the evaporator and a capillary tube through which refrigerant passes from a condenser, for vaporizing the refrigerant which has passed through the capillary tube, for separating oil from the refrigerant flowing into the evaporator, comprising:

an inflow member connected to the capillary tube, for receiving oil-containing refrigerant containing from the capillary tube;

a refrigerant outflow member connected between the inflow member and an inlet of the evaporator, for conducting the refrigerant upward to the inlet of the evaporator; and an oil outflow member disposed between the inflow member and an outlet of the evaporator, for conducting the oil downward.

Preferably, the oil separator further comprises an oil guiding tube connected to an outlet of the oil outflow member for guiding the oil which passed through the oil outflow member. Here, the inner diameter of the oil guiding tube is smaller than, and preferably less than ¼ of, that of the refrigerant outflow member to guide the flow of the oil to the evaporator and to prevent the refrigerant from flowing into the oil guiding tube.

It is preferable that an outlet of the oil guiding tube is connected to the outlet of the evaporator, so that oil through the oil guiding tube is mixed with the refrigerant through the evaporator and returns to a compressor in order to prevent the oil in the compressor from being reduced.

It is also preferable that the oil separator further comprises an oil stopper formed on the inner wall of the refrigerant outflow member for preventing the flow of the oil into the evaporator. Here, the oil stopper is formed with an oil stopping tongue downwardly extended from the inner wall of the refrigerant outflow member for accumulating the oil below the oil stopping tongue.

BRIEF DESCRIPTION OF THE DRAWINGS

The above object and advantage of the present invention will become apparent by describing in detail a preferred embodiment thereof with reference to the accompanying drawings in which.

DETAILED DESCRIPTION OF A PREFERRED EMBODIMENT OF THE INVENTION

Figure 1:
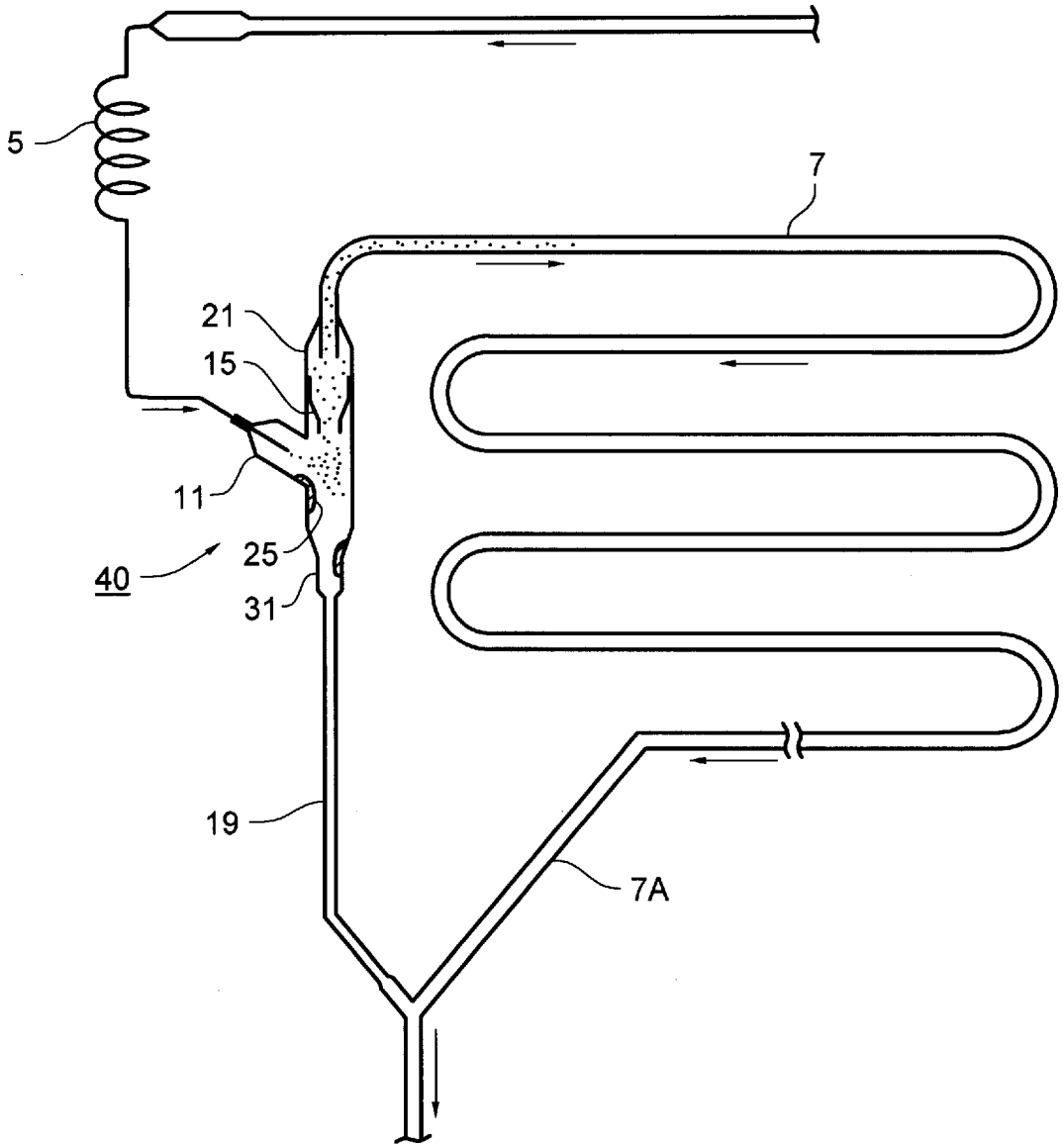
FIG. 1 schematically shows the periphery of an evaporator having an oil separator according to the present invention.

Referring to FIG. 1, an oil separator 40 according to the present invention is disposed between a capillary tube 5 and an evaporator 7, and includes an inflow member 11 disposed at the outlet side of the capillary tube 5 for receiving refrigerant from the capillary tube 5, a refrigerant outflow member 21 connected between the inflow member 11 and an inlet of the evaporator 7 for supplying the refrigerant from the inflow member 11 upward to the evaporator 7, an oil outflow member 31 disposed between the inflow member 11 and an outlet 7*a* of the evaporator 7 and an oil stopper 15 installed between the inflow member 11 and the refrigerant outflow member 21.

Figure 2:
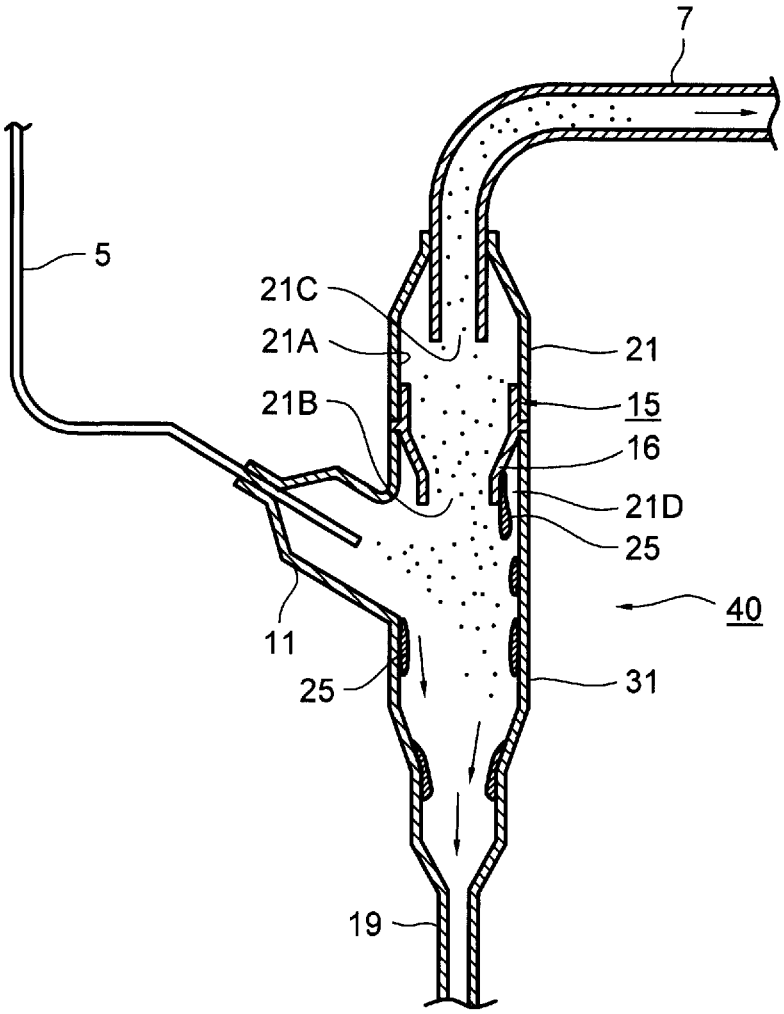
FIG. 2 shows an enlarged section of the oil separator of FIG. 1.
Figure 3:
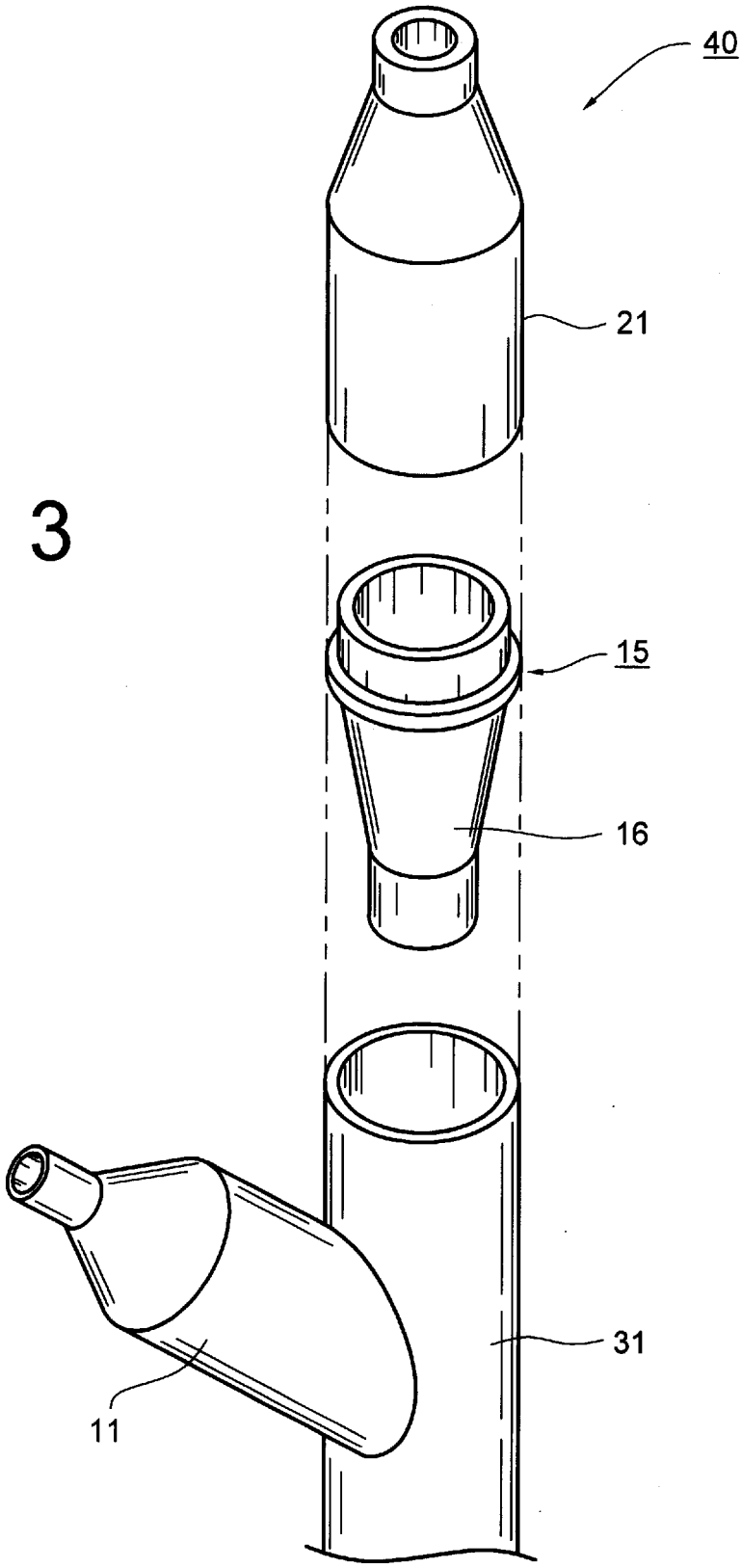
FIG. 3 shows an exploded perspective view of the oil separator of FIG. 1.
Figure 4:
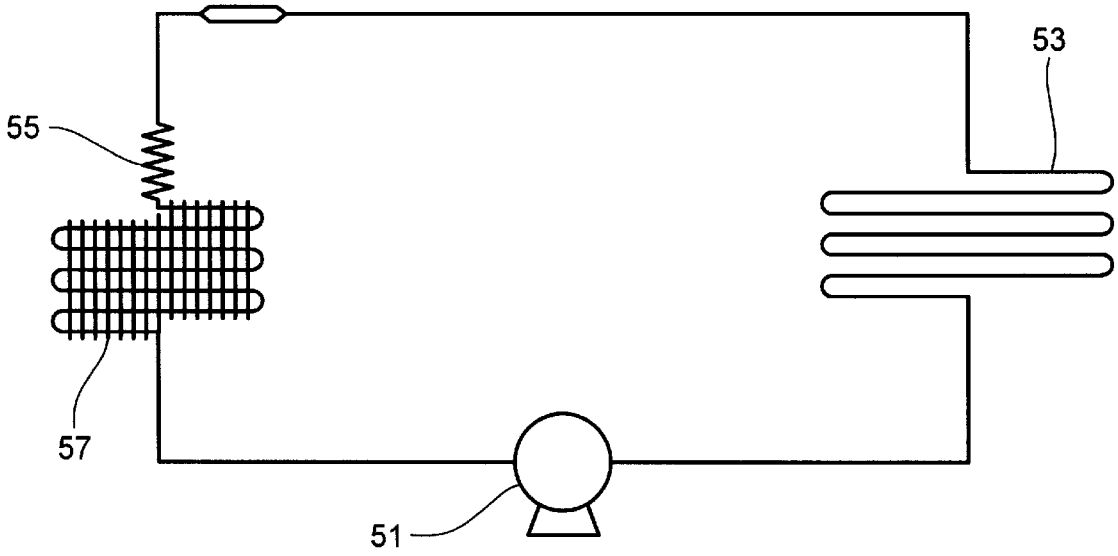
FIG. 4 (PRIOR ART)
FIG. 4 is a schematic diagram of a typical cooling system for generating cool air.
Figure 5:
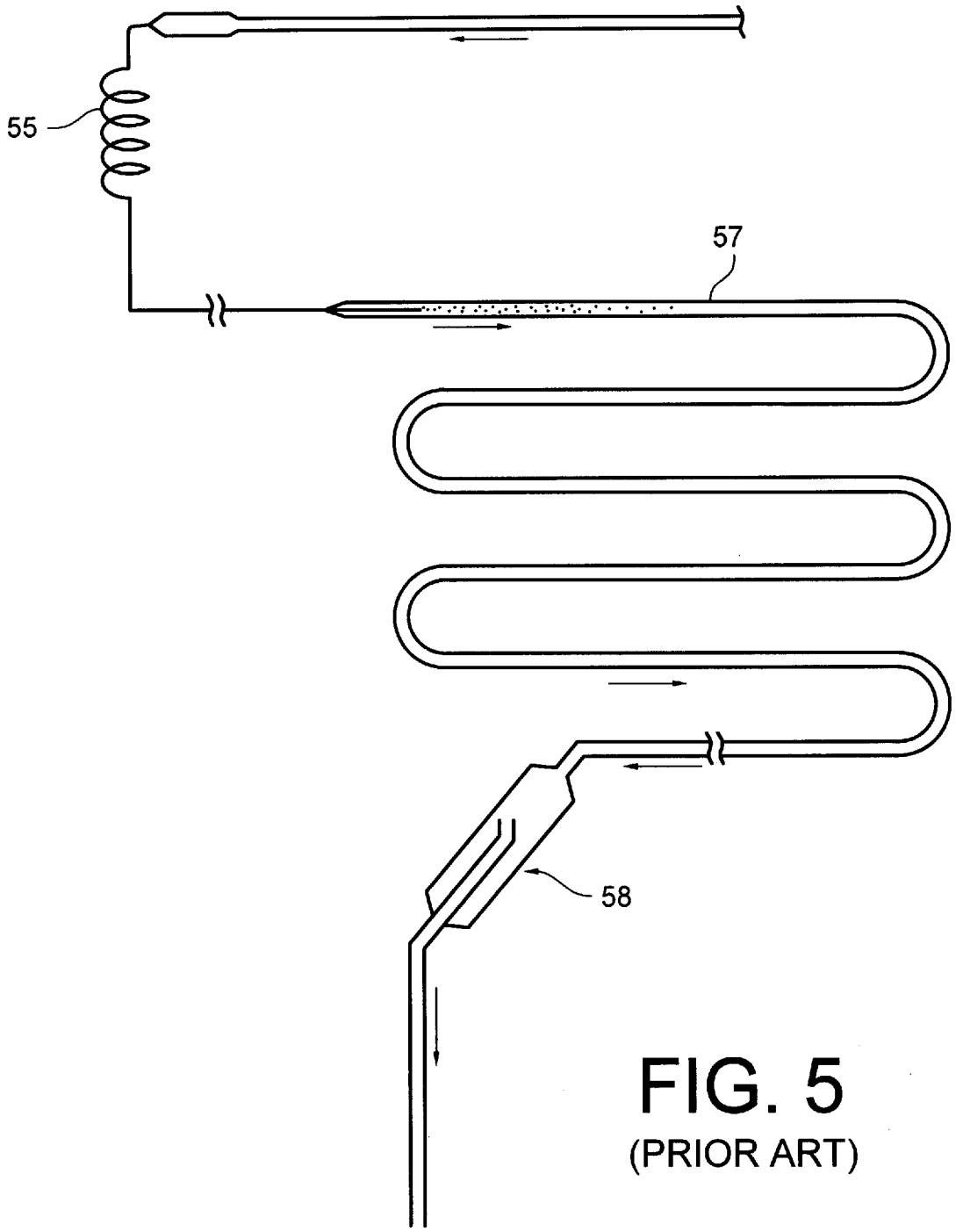
FIG. 5 (PRIOR ART)
FIG. 5 schematically shows the periphery of a conventional evaporator.

Referring to FIGS. 1 to 3, the oil stopper 15 is formed with an oil stopping tongue 16 downwardly extended from the inner wall 21*a* of the refrigerant outflow member 21. The inflow member 11 and the oil stopper 15 and the oil stopper 15 and the refrigerant outflow member 21 are welded, for example, by an electric welding, respectively. The oil outflow member 31 has a downwardly decreasing inner diameter. An oil guiding tube 19 is connected to the lower end of the oil outflow member 31. The oil guiding tube 19 has an inner diameter smaller than, and preferably less than ¼ of, that of the refrigerant outflow member 21. The outlet portion of the oil guiding tube 19 is connected to the outlet 7*a* of the evaporator 7.

The liquid refrigerant from the capillary tube 5 flows into the inflow member 11 to be then evaporated. Since the inner diameter of the oil guiding tube 19 is smaller than that of the refrigerant outflow member 21, including the refrigerant entrance 21*b* and exit 21*c*, most of the evaporated refrigerant flows toward the refrigerant outflow member 21, not toward the oil outflow member 31, to be supplied to the inlet of the evaporator 7. At this time, the lubricating oil contained in the refrigerant is not vaporized and separated from the refrigerant. Part of the separated lubricating oil 25 flows along the inner wall of the oil separator 40 due to its viscosity and another part of the lubricating oil flows downward due to its weight through the oil outflow member 31 toward the oil guiding tube 19. The oil 25 which is attached to the inner wall of the oil accumulating space 21*d* is upwardly forced by the flow of the vaporized refrigerant. The upward flow of the oil 25 is obstructed by the oil stopping tongue 16 of the oil stopper 15, whereby oil 25 accumulates in an oil accumulating space 21*d* disposed beneath the refrigerant outflow member 21. The accumulated oil 25 flows downward due to its weight through the oil outflow member 31 toward the oil guiding tube 19. The gradually-decreasing inner diameter of the oil outflow member 31 facilitates the downward flow of the oil into the oil guiding tube 19.

According to the above-structured oil separator, refrigerant which contains little lubricating oil can be supplied to the evaporator 7.

Meanwhile, since the outlet of the oil guiding tube 19 is connected to the outlet 7*a* of the evaporator 7, the oil passing through the oil guiding tube 19 is mixed with the gaseous refrigerant flowing out of the outlet 7*a* of the evaporator 7. Thus, the oil which is contained in the refrigerant returns to the compressor to compensate for the loss of the oil inside the compressor.

According to the above-described oil separator of the present invention, lubricating oil is separated from refrigerant flowing into an evaporator, thereby preventing accumulation of the oil inside the evaporator and reduction of the oil inside the compressor to increase a cooling efficiency.

What is claimed is:

1. A cooling system comprising:

a condenser;

a capillary tube for receiving refrigerant from the condenser;

an evaporator for vaporizing refrigerant having passed through the capillary tube, the evaporator including an inlet and an outlet; and an oil separator disposed between the capillary tube and the evaporator for separating oil from liquid refrigerant flowing into the evaporator, the oil separator disposed higher than the evaporator outlet and lower than the evaporator inlet, the oil separator comprising:

an inflow member connected to the capillary tube, for receiving oil-containing refrigerant from the capillary tube, a refrigerant outflow member connected between the inflow member and an inlet of the evaporator, for conducting the refrigerant upwardly to the inlet of the evaporator, the outflow member including an inner wall and an oil stopping tongue extending downwardly from the inner wall to form a refrigerant entrance to the outflow member, the refrigerant entrance being spaced from the inner wall, whereby an oil accumulating space is formed beneath the refrigerant outflow member for preventing oil from entering the refrigerant entrance, the refrigerant outflow member further including a refrigerant exit located higher than the refrigerant entrance, an oil outflow member disposed between the inflow member and an outlet of the evaporator, for conducting the oil downwardly, and an oil-guiding tube having an upper end communicating with a lower end of the oil outflow member for receiving oil therefrom, the upper end communicating with the oil accumulating space and disposed below the oil accumulating space whereby oil gravitates from the oil accumulating space to the oil-guiding tube, the oil guiding tube having an inner diameter smaller than a smallest inner diameter of the refrigerant outflow member including the refrigerant entrance and the refrigerant exit thereof, the oil-guiding tube including a lower end connected to the evaporator outlet.

2. The cooling system according to claim 1 wherein the oil-stopping tongue is downwardly tapered.

* * * * *